US011702800B2

(12) United States Patent
Benjamin et al.

(10) Patent No.: US 11,702,800 B2
(45) **Date of Patent: *Jul. 18, 2023**

(54) RAILROAD SPIKE REMOVER

(71) Applicant: FTS Tools, LLC, Lynchburg, VA (US)

(72) Inventors: Timothy J. Benjamin, Newnan, GA (US); Kristopher Andre Alonzo, Lawrenceville, GA (US); Mir Mohamed Atiqullah, Powder Springs, GA (US); Trevor Lee-Michael Barnby, Tallapoosa, GA (US); Samuel Horace Gantt, Marietta, GA (US); Jonathan Hawkins, Decatur, GA (US); Alexander Hood, Buford, GA (US); Timothy K. Lawler, Whitestown, IN (US); Laura Ann Ruhala, Powder Springs, GA (US); Daniel Richard Scott, Kennesaw, GA (US); Zachary Tonsmeire, Cartersville, GA (US); Kyle D. Wise, Newnan, GA (US)

(73) Assignee: FTS Tools, LLC, Lynchburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/486,896

(22) Filed: Sep. 27, 2021

(65) Prior Publication Data

US 2022/0081850 A1 Mar. 17, 2022

Related U.S. Application Data

(60) Continuation of application No. 16/784,068, filed on Feb. 6, 2020, now Pat. No. 11,131,067, which is a (Continued)

(51) Int. Cl.
*B25C 11/00* (2006.01)
*E01B 29/26* (2006.01)

(52) U.S. Cl.
CPC ..... *E01B 29/26* (2013.01); *B25C 11/00* (2013.01)

(58) Field of Classification Search
CPC ..... E01B 29/26; B25C 11/00
See application file for complete search history.

(56) References Cited

U.S. PATENT DOCUMENTS 131,050 A * 9/1872 Butler ..... B25C 11/00 29/259
577,783 A 2/1897 Powell
(Continued)

FOREIGN PATENT DOCUMENTS

CA 2.969.795 A1 12/2017
DE 520526 C 3/1931
(Continued)

OTHER PUBLICATIONS

EESR dated May 12, 2020 issued in Appln. No. 20150387.7.
(Continued)

*Primary Examiner* — Nirvana Deonauth
(74) *Attorney, Agent, or Firm* — Banner & Witcoff, Ltd.

(57) ABSTRACT

A portable railroad spike remover comprises an extractor that is shaped to engage and secure a railroad spike previously installed into a rail tie. A drive shaft is connected to the extractor such that as the drive shaft is rotated, the extractor is vertically raised and lowered within a main column. The extractor may have an opening extending through at least one side to engage the railroad spike.

29 Claims, 6 Drawing Sheets

Related U.S. Application Data division of application No. 15/175,900, filed on Jun. 7, 2016, now Pat. No. 10,597,828.

(56) References Cited

U.S. PATENT DOCUMENTS

| | | | | |
|---|---|---|---|---|
| 737,530 | A | 8/1903 | Tillberg | |
| 1,830,269 | A | 11/1931 | Ford | |
| 2,545,027 | A * | 3/1951 | Charless | E01B 29/26 254/25 |
| 2,639,887 | A | 5/1953 | Henry | |
| 2,691,505 | A | 10/1954 | Hursh | |
| 2,735,649 | A | 2/1956 | Swallert | |
| 3,594,890 | A | 7/1971 | Cordell et al. | |
| 3,830,633 | A | 8/1974 | Harbottle | |
| 4,273,052 | A | 6/1981 | Woolner et al. | |
| 4,538,793 | A | 9/1985 | Dieringer et al. | |
| 4,579,061 | A | 4/1986 | Dieringer | |
| 4,928,600 | A | 5/1990 | Umson, Jr. et al. | |
| 5,161,292 | A * | 11/1992 | Kurtyak | E01B 29/32 254/131 |
| 5,465,667 | A | 11/1995 | Hosking et al. | |
| 5,924,679 | A | 7/1999 | Wilson | |
| 6,095,053 | A | 8/2000 | Johnson et al. | |
| 6,098,960 | A | 8/2000 | Lafavour et al. | |
| 6,113,073 | A | 9/2000 | Lefavour et al. | |
| 6,718,851 | B1 | 4/2004 | Peggion | |
| 7,353,757 | B2 | 4/2008 | Elkridge | |
| 8,371,556 | B2 * | 2/2013 | Price | B25F 3/00 254/98 |
| 8,485,103 | B2 | 7/2013 | Miller et al. | |
| 9,637,867 | B2 | 5/2017 | Burns | |
| 9,839,999 | B2 | 12/2017 | Kittell | |
| 11,131,067 | B2 * | 9/2021 | Benjamin | E01B 29/26 |
| 2007/0113752 | A1 | 5/2007 | Elkridge | |
| 2009/0236572 | A1 * | 9/2009 | Laun | B25C 11/02 254/18 |
| 2009/2386572 | | 9/2009 | Laun | |
| 2011/0131783 | A1 | 6/2011 | Betcher | |
| 2012/0199037 | A1 | 8/2012 | Miller et al. | |
| 2013/0240806 | A1 | 9/2013 | Crover | |
| 2016/0023873 | A1 | 1/2016 | Kasan | |
| 2016/0040365 | A1 * | 2/2016 | Burns | E01B 29/32 254/21 |
| 2017/0058461 | A1 | 3/2017 | Weatherill et al. | |

FOREIGN PATENT DOCUMENTS

| | | | |
|---|---|---|---|
| EP | 1041203 | A1 | 10/2000 |
| EP | 3255207 | A1 | 12/2017 |
| GB | 794433 | A | 5/1958 |

OTHER PUBLICATIONS

EESR dated Nov. 3, 2017 issued in Appln. No. 17174787.6.
EESR dated Mar. 18, 2020 issued in Appln. No. 19216949.8.
Stanley Hydraulic Spike Puller SPL31 A-Nm SPL31 A-S User Manual, Black & Decker, Inc. (2013).

* cited by examiner

RAILROAD SPIKE REMOVER

CROSS-REFERENCE TO RELATED APPLICATIONS

This application is a continuation of U.S. patent application Ser. No. 16/784,068, entitled "Railroad Spike Remover," filed Feb. 6, 2020, which is a divisional application of U.S. patent application Ser. No. 15/175,900, entitled "Railroad Spike Remover," filed Jun. 7, 2016 (which issued as U.S. Pat. No. 10,597,828 on Mar. 24, 2020), the content of each of which is hereby incorporated herein by reference in their entirety.

FIELD OF INVENTION

The field of invention for this disclosure relates to a portable railroad spike remover.

BACKGROUND

Removing railroad spikes from a rail tie has not changed much over time. Railroad spikes are often removed from a rail tie manually using a crowbar. A railroad spike may need as much as 5,000 pounds of vertical force to remove a spike embedded in a rail tie. A portable device to easily remove the railroad spikes would be a great improvement.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

The present disclosure provides an apparatus for removing railroad spikes from a rail tie that is portable and easy to use.

According to one aspect of the disclosure, an apparatus for removing a railroad spike from a rail tie comprises: a main column, a drive shaft connected to the main column, and an extractor connected to the drive shaft. The extractor may have an opening to secure a railroad spike. Further wherein, when the drive shaft is rotated, the extractor moves inside the main column in a vertical direction to extract the railroad spike from a rail tie. The drive shaft may have a first end, and a second end, wherein the first end includes a drive element and the second end includes threaded portion. The main column may have a first end and a second end, wherein the first end has a bearing housing connected to the main column, wherein the bearing housing contains a bearing, and the drive shaft extends through the bearing and the bearing housing. Further, a first extractor may comprise a top surface, a bottom surface, and a plurality of side surfaces, and the opening of the extractor extends through the top surface, the bottom surface and at least one side surface and wherein the opening has an upper portion and a lower portion. Additionally, a second extractor may comprise a top surface, a bottom surface, and a plurality of side surfaces, and the opening of the extractor extends through the bottom surface and at least two side surfaces. Further, the opening may have a first guide rail, a second guide rail, a first side wall adjacent the first guide rail, a second side wall adjacent the second guide rail, and an upper surface connecting the first guide rail to the second guide rail.

According to another aspect of the disclosure, an apparatus for removing a railroad spike from a rail tie comprises: a main column having a first end and a second end; a bearing housing connected to the first end of the main column containing a bearing; a drive shaft extending through the bearing and the bearing housing and connected to a mounting flange, wherein the mounting flange is connected to an extractor positioned near the second end of the main column via a plurality of standoffs. The drive shaft may extend through the bearing and the bearing housing and may be connected to the mounting flange and wherein the mounting flange is connected to the extractor via the plurality of standoffs. The extractor may comprise a top surface, a bottom surface, and a plurality of side surfaces, and an opening of the extractor extends through the bottom surface and at least two side surfaces. Further, when the drive shaft is rotated, the mounting flange and the extractor may move inside the main column in a vertical direction.

According to another aspect of the disclosure, a method of removing a railroad spike from a rail tie may comprise: positioning a railroad spike remover near a railroad spike; sliding a top of the railroad spike into an opening of an extractor of the railroad spike remover; positioning the railroad spike remover over the railroad spike; engaging a drive element of a drive shaft of the railroad spike remover with a rotating tool; and rotating the drive shaft with the rotating tool to raise the extractor and the railroad spike from a rail tie.

BRIEF DESCRIPTION OF THE DRAWINGS

The present invention is illustrated by way of example and not limited in the accompanying figures in which like reference numerals indicate similar elements and in which.

Figure 1:
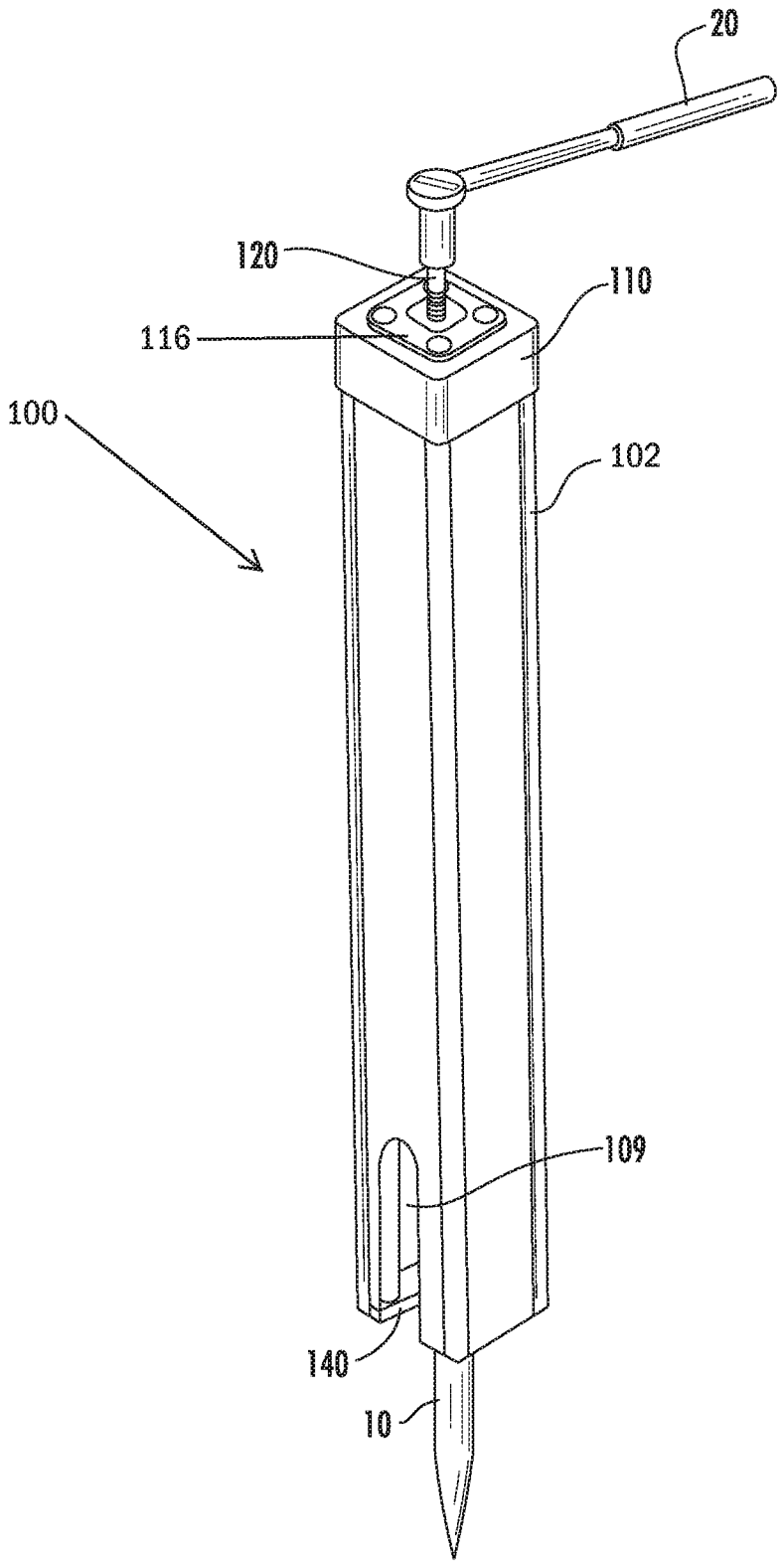
FIG. 1 illustrates a top front perspective view of an example embodiment of a rail spike remover according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Connected," as used herein, indicates that components may be connected directly being physically contacting each other or connected indirectly where the components are connected indirectly where the components do not physically contact, but have one or more intermediate components positioned between them.

"Integral joining technique" or means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to an apparatus to remove railroad spikes from a rail tie comprising a main column, a drive shaft and an extractor. More detailed descriptions of aspects of this invention follow.

Figure 2:
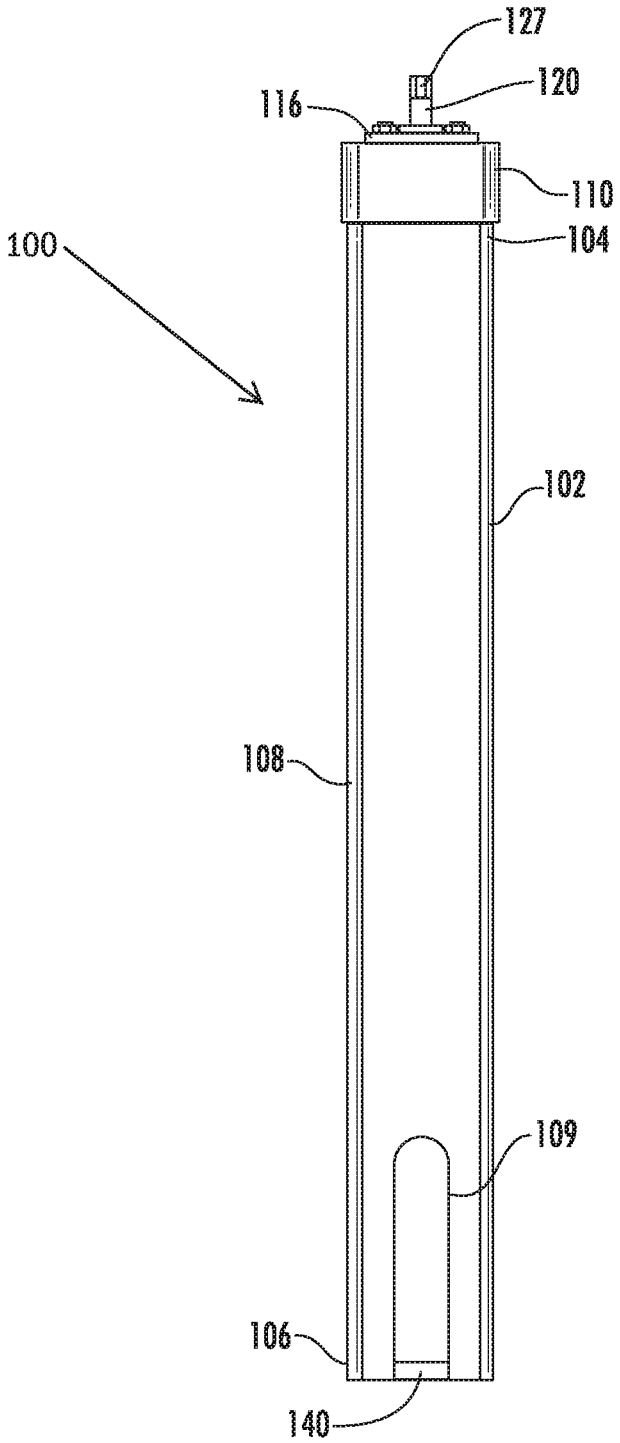
FIG. 2 illustrates a front view of the example embodiment of the rail spike remover of FIG. 1.
Figure 3:
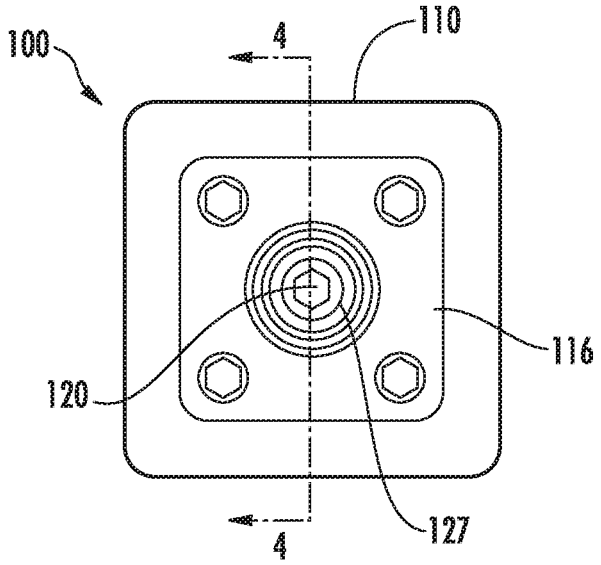
FIG. 3 illustrates a top view of the example embodiment of the rail spike remover of FIG. 1.
Figure 4:
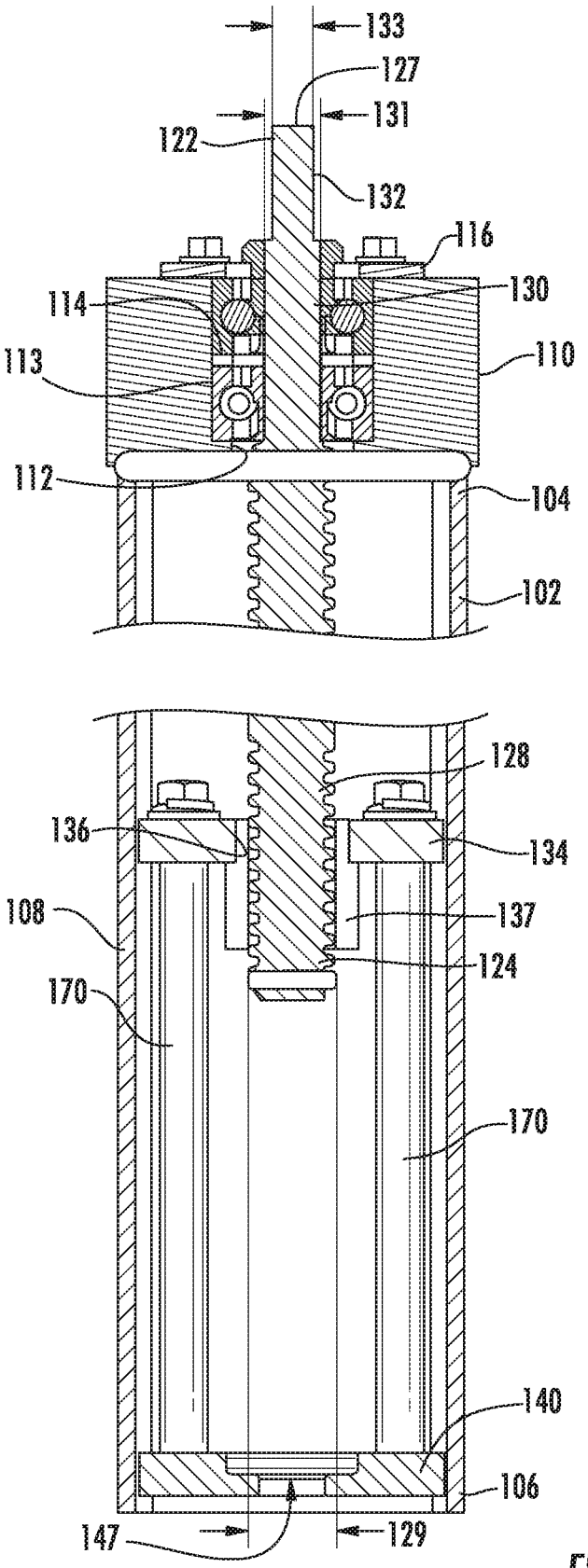
FIG. 4 illustrates a cross-sectional view of the example embodiment of the rail spike remover of FIG. 1.

One aspect of this invention relates to a portable railroad spike remover 100, as shown in FIGS. 1-4. Specifically, FIG. 1 illustrates a top front perspective view of an example embodiment of a railroad spike remover 100. FIG. 2 illustrates a front view of the railroad spike remover 100. FIG. 3 illustrates a top view of the railroad spike remover 100. FIG. 4 illustrates a cross-sectional view of the railroad spike remover 100. The railroad spike remover 100 may comprise a main column 102, a bearing housing 110, a plurality of standoffs 170, a mounting flange 134, an extractor 140, and a drive shaft 120. The main column 102 may have a first end 104, a second end 106 opposite the first end 104, and a center section 108 positioned between the two ends. The bearing housing 110 may be connected to the first end 104 of the main column 102 and have an opening 112 for inserting the drive shaft 120. The drive shaft 120 may also extend through a bearing 114 secured in the bearing housing 110 by a cap plate 116.

As illustrated in FIG. 4, the drive shaft 120 may have a first end 122 and a second end 124 opposite the first end 122. Near the first end 122, the drive shaft 120 may extend through an opening in the bearing 114, through an opening 112 in the bearing housing 110, and through an opening in the cap plate 116. Near the second end 124, the drive shaft 120 may connect to the mounting flange 134. The drive shaft 120 may be secured to the mounting flange 134 using a nut 137.

The plurality of standoffs 170 may connect to the mounting flange 134 at one end and to the extractor 140 at the opposite end. Alternatively, the drive shaft 120 may connect directly to the extractor 140 without the need for the mounting flange 134 and the plurality of standoffs 170. The extractor 140 may engage and grip the railroad spike 10 to secure it. Once the extractor 140 secures the railroad spike 10, a user may engage the first end 122 of the drive shaft 120 with a tool to provide torque to the drive shaft 120. As the drive shaft 120 is rotated, the mounting flange 134 and the extractor 140 may move inside the column in a vertical direction to extract the railroad spike 10 from a rail tie. As the extractor 140 moves up within the main column 102, the railroad spike 10 is removed from the rail tie.

The main column 102 may have a plurality of substantially vertical side walls that are open at both ends 104, 106. The main column may have a height of approximately 32 inches or within a range of 24 to 40 inches or any height. As shown in the exemplary embodiment shown in FIGS. 1-9, the main column 102 may generally have a square cross-sectional shape. However, the main column may have any geometric cross-sectional shape, such as circular, triangular, such that the main column 102 may have any number of side walls. For example as shown in FIGS. 1 and 3, the main column 102 may have four side walls, but may have 3 side walls, 5 side walls, 6 side walls or any number of side walls. The side walls may have a thickness of approximately 0.188 inches or within a range of 0.125 inches to 0.25 inches, or within a range of 0.06 inches to 0.375 inches. Each side wall may have a width of approximately 4 inches or within a range of 3 inches to 5 inches, or within a range of 2 inches to 6 inches.

As shown in FIG. 2, at least one side wall of the main column 102 may have an aperture 109 that extends from the second end 106 to a portion of the height of the main column 102. For example, the aperture 109 may have a height of approximately 20 percent of the height of the main column 102 or the aperture 109 may have a height that is within a range of 12 percent to 37 percent of the height of the main column. The aperture 109 may have an elongated shape and may have a height of approximately 7 inches or may be within a range of 5 inches to 9 inches. In addition, the aperture 109 may have a width of approximately 1.5 inches or within a range of 1.0 inch to 2.5 inches. The aperture 109 may align with the opening 147 of the extractor 140 to allow the railroad spike remover 100 to slide into position to engage the railroad spike 10 with the extractor 140.

The bearing housing 110 may be integrally joined to the first end 104 of the main column 102. Alternatively, the bearing housing 110 and main column 102 may be formed as a single piece. As previously discussed, the bearing housing 110 may have an opening 112. The opening 112 may be located in the geometric center of the bearing housing 110 and may have a cylindrical shape to allow the drive shaft 120 to extend through the bearing housing 110. The opening 112 may be through both ends of the bearing housing 110. In addition, the bearing housing 110 may have a cavity 113 that is concentric with the opening 112. The cavity 113 may be sized to contain the bearing 114 and have a cylindrical shape that is open at one end with a surface at the opposite end to engage one end of the bearing 114. The bearing housing 110 may also have a plurality of holes around the perimeter of the housing. The plurality of holes may be threaded to releasably connect the cap plate 116. The bearing 114 may be a roller bearing or bushing that enables the drive shaft 120 to rotate freely when the bearing 114 is installed onto the drive shaft 120 and into the bearing housing 110.

The drive shaft 120 may have a first end 122 and a second end 124 and may be partially threaded. As shown in FIG. 4, the drive shaft 120 may have a plurality of distinct diameter regions. For example, the drive shaft 120 may have a first region 128 with a first diameter 129 corresponding to the threaded region, a second region 130 having a second diameter 131 with a smooth surface, and a third region 132 which may have a third diameter 133. The first diameter 129 may be greater than both the second diameter 131 and the third diameter 133. The first diameter 129 may be approximately 1 inch or within a range of 0.75 inches and 1.5 inches or within a range of 0.5 inches to 2.0 inches. The threaded portion (first region 128) may be ACME threads or other similar threads. Alternatively, the drive shaft 120 may have two distinct diameter regions or four distinct diameter regions.

The first end 122 may have a drive element 127 to allow a user to engage the drive shaft 120 with a rotating tool, such as a torque wrench 20 or similar device to rotate the drive shaft 120. As shown in FIG. 3, the drive element 127 may have a hexagonal shape to be engaged by a standard hexagonal socket. The standard hexagonal socket may be 0.5 inches or larger. Preferably, the torque wrench 20 has a length of 18 inches or longer. A battery-operated drill-type apparatus or an air hammer attached to a pneumatic supply could be utilized as the rotating tool in lieu of the torque wrench 20, thereby engaging the drive shaft 120 and rotating the drive shaft 120 to move the drive shaft 120 up and down.

As discussed the drive shaft 120 may connect to the mounting flange 134. The mounting flange 134 may have a centrally located aperture 136 to connect the drive shaft 120. The mounting flange 134 may be connected to the drive shaft in a plurality of ways. For example, the aperture 136 may be threaded to directly engage the drive shaft 120, or alternatively as shown in FIG. 4, a nut 137 may be connected to the aperture 136 of the mounting flange 134 where the drive shaft 120 may connect to the mounting flange 134 with the nut 137 positioned between the mounting flange 134 and the drive shaft 120. The nut 137 may be integrally joined to the mounting flange 134 or some may be connected using an anti-rotation element to prevent the nut 137 from rotating in relation to the mounting flange 134 when the drive shaft 120 is rotated, such as a set screw. The mounting flange 134 may also have a plurality of mounting holes positioned around the perimeter to allow for easy connection to the plurality of standoffs 170. The mounting flange 134 may be releasably connected to the standoffs 170 or the drive shaft 120 to allow any repairs that may be required.

The plurality of standoffs 170 may be hollow tubes that connect at a first end to a mounting flange 134 and a second end of connected to an extractor 140. Each standoff 170 may have internal threads such that they may be releasably connected using a threaded fastener. Alternatively, the plurality of standoffs 170 may be integrally joined to the either the mounting flange 134 or extractor 140 or both.

Each standoff 170 may be approximately 7 inches long or within a range of 5 inches to 9 inches or within a range of 3 inches to 12 inches. Each of the standoffs 170 may be the same length, but depending on the shape of the either the mounting flange 134 or extractor 140, each of the standoffs 170 may have different lengths.

Figure 5:
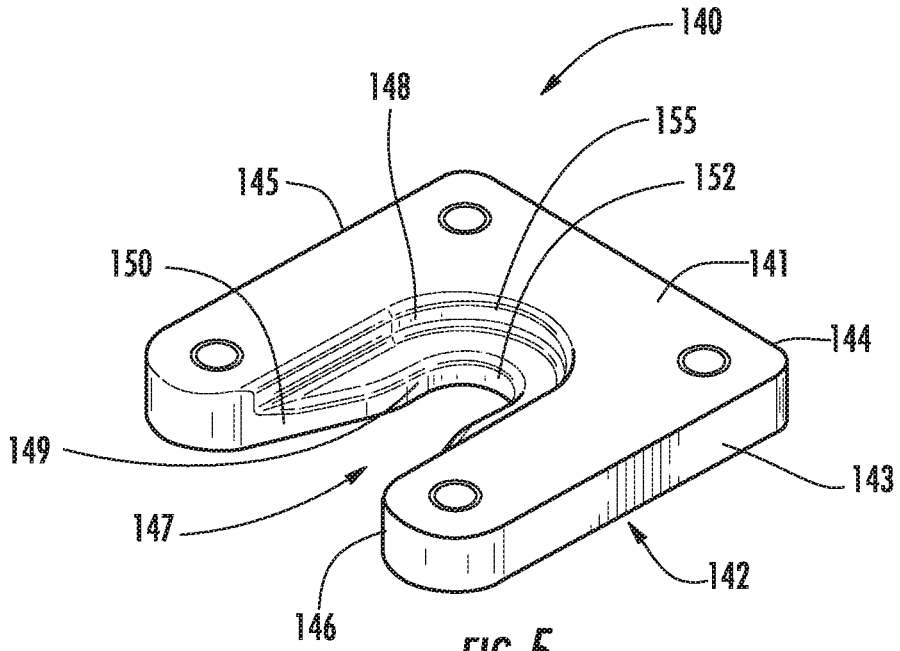
FIG. 5 illustrates a perspective view of an extractor from the example embodiment of the rail spike remover of FIG. 1 with other components removed.
Figure 6:
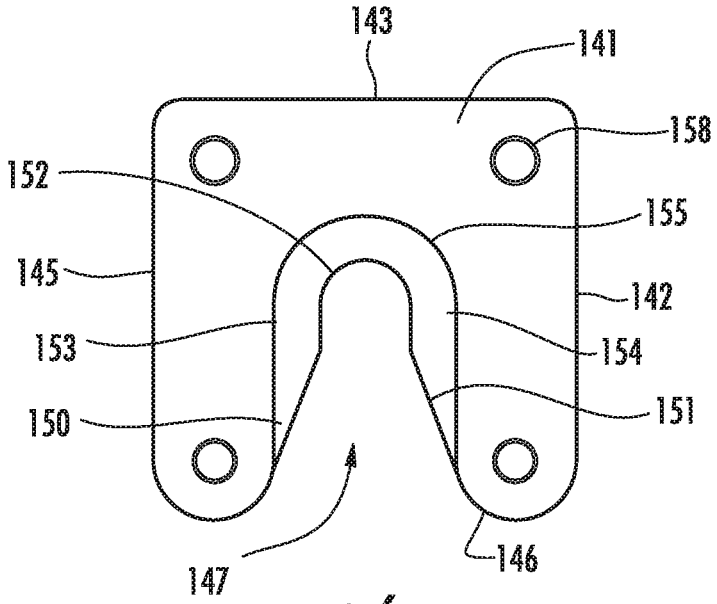
FIG. 6 illustrates a top view of the extractor of FIG. 5.

As discussed above, the plurality of standoffs 170 connect to an extractor 140. As shown in FIGS. 5 and 6, the extractor 140 may comprise a metallic plate with a top surface 141, a bottom surface 142, and a plurality of side surfaces 143, 144, 145, 146. The extractor 140 may further comprise an opening 147 through the top and bottom surface and extending through at least one side surface. The opening may further include an upper portion 148 and a lower portion 149. The lower portion 149 of the opening may have a plurality of tapered side walls 150, 151 and a first rounded rear wall 152. The plurality of tapered side walls 150, 151 may be vertically oriented and taper toward one another. The upper portion 148 of the opening may have vertically oriented side walls 153, 154, and a second rounded rear wall 155, wherein the width of the upper portion 148 is larger than the width of the lower portion 149. The first rounded rear wall 152 and the second rounded rear wall 155 may be concentric. The extractor 140 may have a plurality of holes 158 to releasably connect the extractor 140 to the plurality of standoffs 170. The plurality of holes 158 may be positioned near the side surfaces 143, 144, 145, 146 of the extractor 140 and extend through the top surface 141 and bottom surface 142. The plurality of holes 158 may be threaded or clearance holes for a threaded fastener. Alternatively, as discussed above, the extractor 140 may be integrally joined to the standoffs 170. Additionally, as discussed above, the extractor 140 may be connected directly to the drive shaft 120.

Figure 7:
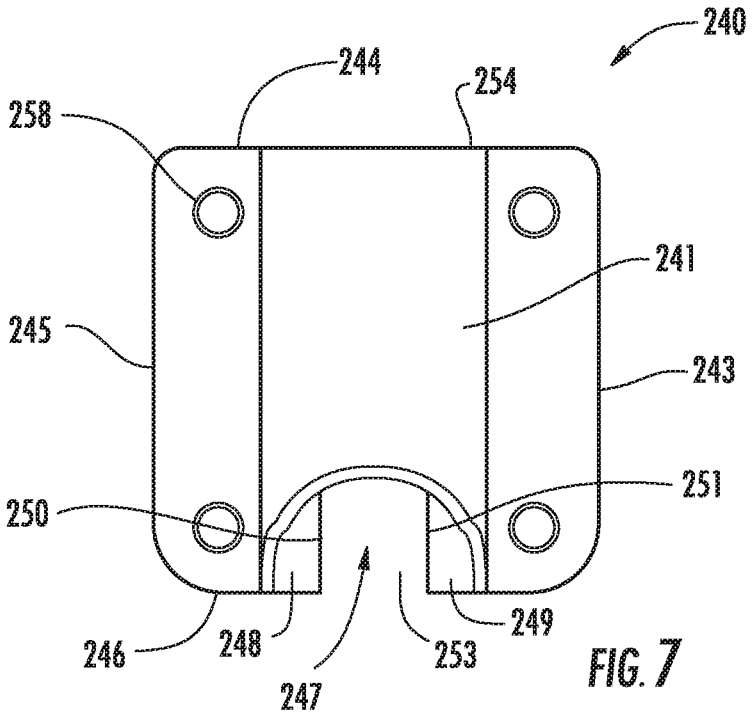
FIG. 7 illustrates a top view of an alternate embodiment of the extractor of the rail spike remover of FIG. 1.
Figure 8:
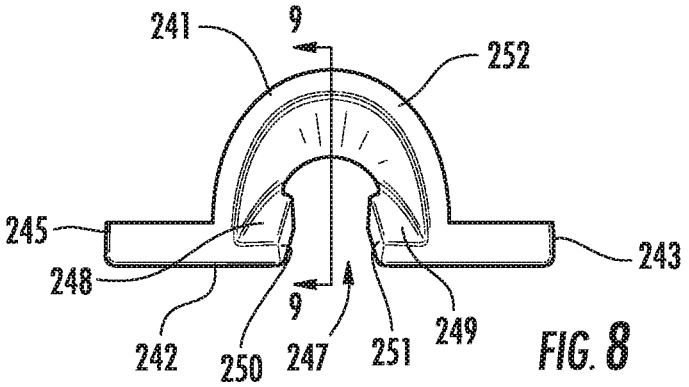
FIG. 8 illustrates a front view of an extractor tooth from the extractor of FIGS. 7.
Figure 9:
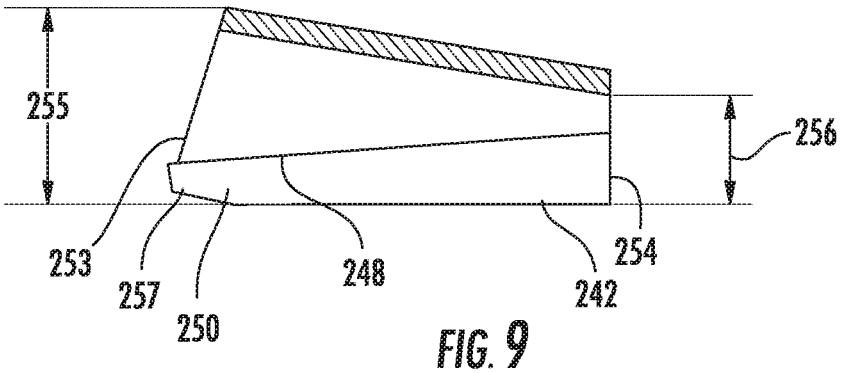
FIG. 9 illustrates a cross-sectional view of the extractor tooth of FIG. 7.

FIGS. 7-9 show an alternate embodiment for the extractor 140. For the embodiment of FIGS. 7-9, the features of the extractor 240 are referred to using similar reference numerals under the "2XX" series of reference numerals, rather than "1XX" as used in the embodiment of FIGS. 5 and 6. Accordingly, certain features of the extractor 240 that were already described above with respect to the extractor 140 of FIGS. 5-6 may be described in lesser detail, or may not be described at all.

The extractor 240 may have the similar exterior shape as extractor 140 to fit within the main column 102 with a top surface 241, a bottom surface 242, and a plurality of side surfaces 243, 244, 245, 246. An opening 247 may extend through at least two side surfaces and the bottom surface 242. The opening 247 may include a first guide rail 248, a second guide rail 249, a first side wall 250 adjacent the first guide rail, a second side wall 251 adjacent the second guide rail, and an upper surface 252 connecting the first guide rail 248 to the second guide rail 249. The upper surface 252 of the opening may be rounded and exposed to the exterior. The opening 247 may have a first end 253 and a second end 254, wherein a first height 255 at the first end 253 may be defined as a distance perpendicular from the bottom surface 242 of the extractor 240 to the furthest extent of the upper surface 252 and the second end 254 may have a second height 256 defined from the bottom surface 242 to the furthest extent of the second end 254 of the upper surface 252. The bottom surface 242 may further include an angled region 257, such that the angled region 257 angles upward toward the first end 253 of the opening 247.

Additionally, the top surfaces of the first guide rail 248 and the second guide rail 249 may be coplanar surfaces. The first guide rail 248 may have a height at the first end 253 of the opening 247 defined as a perpendicular distance from the bottom surface 242 of the extractor 240 to the furthest extent of the first end 253 of the first guide rail 248. Similarly, the second end 254 may have a second height defined as a perpendicular distance from the bottom surface 242 to the furthest extent of the second end 254 of the first guide rail 248, wherein the first height is smaller than the second height. The guide rails 248, 249 may be linear surfaces and angle in a direction away from the bottom surface 242. Thus, the opening 247 may be larger at the first end 253 than at the second end 254.

The first side wall 250 adjacent the first guide rail 248 and the second side wall 251 adjacent the second guide rail 249 are parallel. Alternatively, the first side wall 250 adjacent the first guide rail 248 and the second side wall 251 adjacent the second guide rail 249 are angled toward one another. Also, similar to the extractor 140, the extractor 240 may have a plurality of holes 258 to connect the extractor 240 to the plurality of standoffs 170.

The various components for the railroad spike remover 100, such as the main column 102, the bearing housing 110, the drive shaft 120, the mounting flange 134, the plurality of standoffs 170, and the extractor 140, 240 may be made of a metallic material, preferably a steel alloy. Alternatively, the components may be made of other metallic materials such as iron, aluminum, an aluminum alloy, titanium, or a titanium alloy.

The railroad spike remover 100 may be portable for a single user to move and operate. Thus, the railroad spike remover 100 may have a weight of less than 50 pounds.

To operate the railroad spike remover 100, a user may position the railroad spike remover 100 near a railroad spike 10 and then slide the opening 147 of the extractor 140 onto the top of the railroad spike 10 such that the railroad spike 10 is secured in extractor 140. The user may then position the railroad spike remover 100 over the railroad spike 10. The user then engages the drive element 127 with the torque wrench 20 and rotates the drive shaft 120 to raise the mounting flange 134 and the extractor 140. As the drive shaft 120 is turned, the extractor 140, along with the railroad spike 10, raises into the main column 102 until the railroad spike 10 is released from the rail tie. Then, the user may reverse the drive shaft 120 to lower the mounting flange 134 and the extractor 140 to allow the railroad spike remover 100 to be ready to remove another railroad spike 10. As was discussed above, a battery operated drill-type apparatus or an air hammer attached to a pneumatic supply could be utilized in lieu of the torque wrench, thereby engaging the drive shaft 120 and rotating the drive shaft to move the drive shaft 120 up and down.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A method of removing a railroad spike from a rail tie, the method comprising:

positioning a railroad spike remover proximate a railroad spike;

sliding a top of the railroad spike into an opening of an extractor of the railroad spike remover, wherein the extractor comprises a top surface, a bottom surface, and a plurality of side surfaces, and the opening of the extractor extends through the top surface, the bottom surface, and at least one side surface of the plurality of side surfaces, and wherein the opening has an upper portion and a lower portion, wherein the lower portion has a plurality of tapered side walls and a first rounded rear wall;

positioning the railroad spike remover over the railroad spike;

engaging a drive element of a drive shaft of the railroad spike remover with a rotating tool;

rotating the drive shaft with the rotating tool to raise the extractor and extract the railroad spike from the rail tie; and reverse-rotating the drive shaft with the rotating tool to lower the extractor and prepare the railroad spike remover to extract another railroad spike.

2. The method of claim 1, wherein the opening of the extractor is on at least two side surfaces of the plurality of side surfaces of the extractor and the opening is larger on a first side of the plurality of side surfaces than on a side of the plurality of side surfaces opposite the first side.

3. The method of claim 1, wherein the opening of the extractor extends through the bottom surface and at least two side surfaces of the plurality of side surfaces.

4. The method of claim 1, wherein the opening has a first guide rail, a second guide rail, a first side wall adjacent the first guide rail, a second side wall adjacent the second guide rail, and an upper surface connecting the first guide rail to the second guide rail, wherein: a top surface of the first guide rail and a top surface of the second guide rail are coplanar surfaces; or the upper surface is rounded.

5. The method of claim 1, wherein the drive shaft has a first end and a second end, wherein the first end includes the drive element and the second end includes a threaded portion.

6. The method of claim 1, wherein the drive shaft is connected to a mounting flange, and wherein the mounting flange is connected to the extractor.

7. The method of claim 6, wherein the drive shaft is connected to a main column of the railroad spike remover, the main column having a first end and a second end, wherein the first end of the main column has a bearing housing connected to the main column, wherein the bearing housing contains a bearing, and wherein the drive shaft extends through the bearing and the bearing housing.

8. The method of claim 7, wherein the extractor is positioned proximate the second end of the main column via a plurality of standoffs, the plurality of standoffs having a first end and a second end, the first end of the plurality of standoffs directly connected to the mounting flange and the second end of the plurality of standoffs connected to the extractor, wherein the plurality of standoffs are hollow tubes with a length of between 3 and 12 inches.

9. The method of claim 7, wherein the main column has four substantially vertical side walls that are open at a first and second end, and wherein the main column has a square cross-sectional shape.

10. The method of claim 7, wherein the drive shaft extends through the bearing proximate a first end of the drive shaft and an opening on the bearing housing, the bearing housing further including a cavity that is concentric with the opening on the bearing housing and the cavity is sized to contain the bearing and have a cylindrical shape that is open at one end with a surface at an opposite end to engage the bearing.

11. The method of claim 7, wherein when the drive shaft is rotated, the extractor moves inside the main column in a vertical direction to extract the railroad spike from the rail tie.

12. The method of claim 1, wherein the railroad spike remover has a weight less than 50 pounds.

13. The method of claim 1, wherein the rotating tool is a torque wrench.

14. The method of claim 1, wherein the rotating tool is a battery-operated drill apparatus.

15. The method of claim 1, wherein the rotating tool is an air hammer attached to a pneumatic supply.

16. A method of removing a railroad spike from a rail tie, the method comprising:

positioning a railroad spike remover proximate a railroad spike;

sliding a top of the railroad spike into an opening of an extractor of the railroad spike remover;

positioning the railroad spike remover over the railroad spike;

engaging a drive element of a drive shaft of the railroad spike remover with a rotating tool, wherein the drive shaft is connected to a mounting flange, and wherein the mounting flange is connected to the extractor, wherein the drive shaft is connected to a main column of the railroad spike remover, the main column having a first end and a second end, wherein the first end has a bearing housing connected to the main column, wherein the bearing housing contains a bearing, and wherein the drive shaft extends through the bearing and the bearing housing;

rotating the drive shaft with the rotating tool to raise the extractor and extract the railroad spike from the rail tie; and reverse-rotating the drive shaft with the rotating tool to lower the extractor and prepare the railroad spike remover to extract another railroad spike.

17. The method of claim 16, wherein the opening of the extractor is in at least one side surface of the extractor.

18. The method of claim 16, wherein the opening of the extractor is on at least two side surfaces of the extractor and the opening is larger on a first side than on a side opposite the first side.

19. The method of claim 16, wherein the extractor comprises a top surface, a bottom surface, and a plurality of side surfaces, and the opening of the extractor extends through the top surface, the bottom surface, and at least one side surface of the plurality of side surfaces, and wherein the opening has an upper portion and a lower portion, wherein the lower portion has a plurality of tapered side walls and a first rounded rear wall.

20. The method of claim 16, wherein the extractor comprises a top surface, a bottom surface, and a plurality of side surfaces, and the opening of the extractor extends through the bottom surface and at least two side surfaces of the plurality of side surfaces.

21. The method of claim 16, wherein the opening has a first guide rail, a second guide rail, a first side wall adjacent the first guide rail, a second side wall adjacent the second guide rail, and an upper surface connecting the first guide rail to the second guide rail, wherein: a top surface of the first guide rail and a top surface of the second guide rail are coplanar surfaces; or the upper surface is rounded.

22. The method of claim 16, wherein the drive shaft has a first end and a second end, wherein the first end includes the drive element and the second end includes a threaded portion.

23. The method of claim 16, wherein the extractor is positioned proximate the second end of the main column via a plurality of standoffs, the plurality of standoffs having a first end and a second end, the first end of the plurality of standoffs directly connected to the mounting flange and the second end of the plurality of standoffs connected to the extractor, wherein the plurality of standoffs are hollow tubes with a length of between 3 and 12 inches.

24. The method of claim 16, wherein the main column has four substantially vertical side walls that are open at a first and second end, and wherein the main column has a square cross-sectional shape.

25. The method of claim 16, wherein the drive shaft extends through the bearing proximate a first end of the drive shaft and an opening on the bearing housing, the bearing housing further including a cavity that is concentric with the opening on the bearing housing and the cavity is sized to contain the bearing and have a cylindrical shape that is open at one end with a surface at an opposite end to engage the bearing.

26. The method of claim 16, wherein when the drive shaft is rotated, the extractor moves inside the main column in a vertical direction to extract the railroad spike from the rail tie.

27. The method of claim 16, wherein the rotating tool is a torque wrench.

28. The method of claim 16, wherein the rotating tool is a battery-operated drill apparatus.

29. The method of claim 16, wherein the rotating tool is an air hammer attached to a pneumatic supply.

* * * * *